United States Patent [19]

Sabranski et al.

[11] Patent Number: 5,042,389

[45] Date of Patent: Aug. 27, 1991

[54] CARRIER PROJECTILE

[75] Inventors: Udo Sabranski, Willich; Wolfgang Hoffmann, Velbert; Siegmar Fischer; Günter Sikorski, both of Düsseldorf; Ulrich Theis, Mülheim; Joachim Fiebrich, Düsseldorf; Lutz Börngen, Köln; Ulf Hahn, Ratingen, all of Fed. Rep. of Germany

[73] Assignee: Rheinmetall GmbH, Düsseldorf, Fed. Rep. of Germany

[21] Appl. No.: 556,318

[22] Filed: Jul. 23, 1990

[30] Foreign Application Priority Data

Jul. 24, 1989 [DE] Fed. Rep. of Germany ..... 3924397

[51] Int. Cl.[5] ..... F42B 13/50

[52] U.S. Cl. ..... 102/489; 102/357; 102/532

[58] Field of Search ..... 102/334, 340, 342, 351, 102/357, 393, 489, 505, 532

[56] References Cited

U.S. PATENT DOCUMENTS

| | | | |
|---|---|---|---|
| 236,304 | 1/1881 | Carney | 102/532 |
| 3,719,339 | 3/1973 | Simmons et al. | 102/340 |
| 3,834,312 | 9/1974 | Simmons | 102/340 |
| 4,109,577 | 8/1978 | Bjorkqvist et al. | 102/357 |
| 4,793,260 | 12/1988 | Kruse et al. | 102/489 |

FOREIGN PATENT DOCUMENTS

| | | | |
|---|---|---|---|
| 154762 | 9/1985 | European Pat. Off. | 102/489 |

*Primary Examiner*—Harold J. Tudor
*Attorney, Agent, or Firm*—Spencer & Frank

[57] ABSTRACT

A large-caliber carrier projectile for transporting a payload, with the projectile including an ejection charge and an ejector plate for ejecting the payload from the carrier projectile over a target area. To overcome the problem of the ejector plate colliding with individual bomblets of the payload, and thus causing considerable interference with proper functioning or premature detonations in the air, the ejector plate is an eccentric center of gravity. Alternatively, the ejector plate may be segmented and composed of at least two separable parts which are separated by the action of centrifugal force after ejection from the carrier projectile.

4 Claims, 4 Drawing Sheets

CARRIER PROJECTILE

BACKGROUND OF THE INVENTION

The present invention relates to a large-caliber carrier projectile for transporting a payload and includes an ejection charge and an ejector plate for ejecting the payload from the carrier projectile over a target area.

Such a carrier projectile is shown in FIG. 1. In the illustrated carrier projectile, the payload is composed of a plurality of columnar stacked and nested submunition projectiles or bomblets. However, the payload could just as well be composed of smoke pots, tracer sets provided with parachutes, etc. During ejection of the columnar stacked bomblets, special problems arise. Generally, such a carrier projectile accommodates six bomblet columns along the inner circumference of the carrier casing and one bomblet column in the center of the carrier projectile.

After ejection from the carrier casing of the carrier projectile, the conventionally rotationally symmetrical ejector plate of the carrier projectile is released very late from the center bomblet column. The center bomblet column is not subjected to eccentric centrifugal forces and therefore continues flying in a rather stable manner for a longer period of time than the other bomblet columns. After the separation or release, the solid ejector plate flies very closely past the center column which, once the ejector plate has been released, experiences a bend. It may then happen that the plate collides with the bomblets, and thus causes the bomblets to collide with one another resulting in considerable functional impairment. Damage to sensitive fuse components, such as, for example, spin decelerating fins or the like, may produce duds or premature detonations may occur in the air.

SUMMARY OF THE INVENTION

It is an object of the present invention to provide an ejector plate for a carrier projectile which does not endanger or contact the ejected payload. In particular, if the payload is composed of bomblets, the ejector plate should neither interfere with the centrally disposed submunition column and its relatively stable flight behavior nor with the decentrally disposed submunition columns once they leave the carrier casing.

The above object is generally accomplished according to one embodiment of the present invention in that the ejector plate has an asymmetrical distribution of mass or, in other words, an eccentrically arranged center of gravity. Alternatively, the ejector plate is segmented and is composed of at least two parts which, after ejection from the carrier projectile, are separated by the action of the centrifugal forces acting in the ejection plates.

The asymmetrical application of an additional substance or mass on the ejector plate influences the flight behavior in such a manner that the ejector plate moves at an angle to the original trajectory; this angle being about half as large as the angle of the outer submunition. This arrangement provides the greatest possible security against collision of the ejector plate with the submunition projectiles. The eccentric center of gravity of the ejector plate is advantageously realized by an eccentric arrangement of an additional shaped attachment piece. The ejector plate and the additional shaped attachment piece may here be a unit, that is, they may be made of one piece. A one-piece ejector plate with shaped attachment may be produced as a forged, sintered or cast piece.

As an alternative, the ejector plate may be made of two parts, that is, the additional shaped attachment piece is fastened to the one-piece ejector plate by means of screws, pins, rivets, etc., or by welding.

If the ejector plate is segmented, the separable parts of the ejector plate are advisably given a releasable form-locking connection, e.g. in the form of teeth, in their junction zone. However, the separable parts of the ejector plate may also be releasably connected with one another in their junction zone by a vulcanization layer, e.g. of rubber or silicone rubber, or by gluing. The separable components or segments of the ejector plate may be any desired circle segments or shaped members. A toothed connection between the individual segments may be in the form of sawteeth or rectangular teeth in the manner of a labyrinth seal.

The vulcanized connection of the segments is designed so that the individual parts of the ejector plate are reliably separated from one another even if the smallest normal charge is employed to fire the carrier projectile.

The invention will be described in greater detail below with reference to embodiments thereof that are illustrated in the drawing figures.

DETAILED DESCRIPTION OF THE PREFERRED EMBODIMENTS

Figure 1:
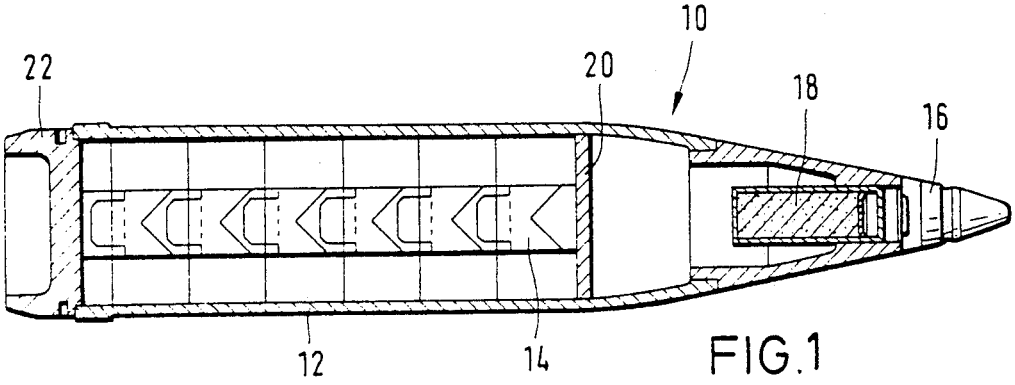
FIG.1 (PRIOR ART)
FIG. 1 is a schematic sectional view of a conventional payload projectile.

FIG. 1 shows a conventional spin-stabilized carrier projectile 10 having cylindrical casing or body 12 containing a payload 14 composed of several columns of bomblets, a fuse 16 at its tip, an ejection charge 18, an ejector plate 20 and a projectile bottom 22 at the rear of and closing the casing 12. A central bomblet column of the payload 14 is indicated schematically.

Figure 2A:
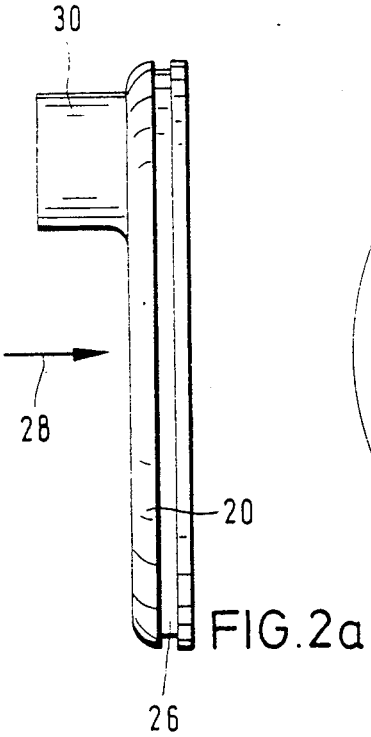
FIGS. 2, 2*a* and 2*b*, 3 and 3*a*, 4 and 4*a* and 5 and 5*a* are respective top and side views of various embodiments of an ejector plate according to the invention for a projectile as shown in FIG. 1.
Figure 2:
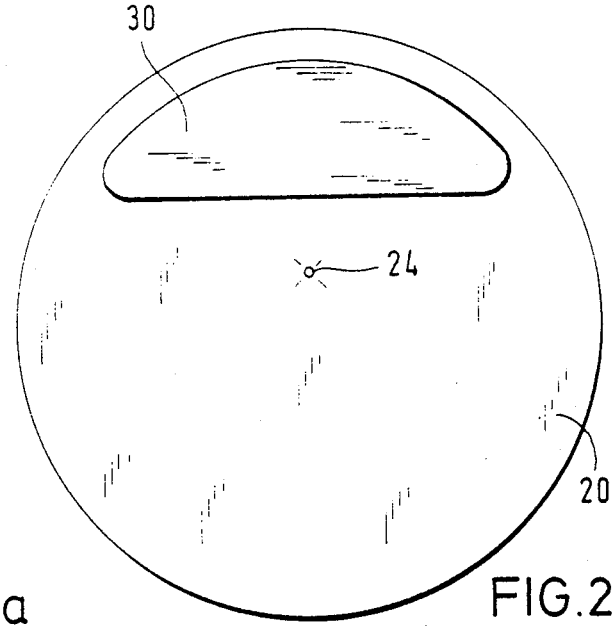
Figure 2B:
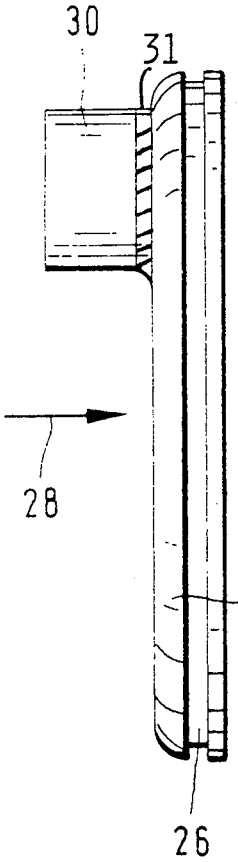

After reaching a target area, the ejection charge 18 is ignited and causes the payload 14, here a plurality of bomblet projectiles, to be ejected rearwardly from the cylindrical casing 12 of carrier projectile 10 by means of gas pressure acting on ejector plate 20. A conventional rotationally symmetrical ejector plate is released only slowly and may impact on the rather stably flying central bomblet column, thus damaging individual bomblets. This is prevented with the ejector plate 20 according to the present invention which is illustrated in FIGS. 2, and 2*a* and 2*b* in that, on its end surface facing the fuse 16, the ejector plate 20 is provided with an eccentrically disposed additional shaped attachment piece 30. This results in an asymmetrical distribution of mass and an eccentric center of gravity 24 for the plate 20. FIG. 2*a* illustrates the ejector plate 20 and the attachment piece 30 as a one piece unitary structure. FIG. 2*b* illustrates the ejector plate 20 and the attachment piece 30 as two separate pieces attached by welding 31. Alternatively, the two pieces can be attached by screws, rivets or gluing. The arrow 28 schematically represents the ejection direction of the ejector plate. At its outer circumference, ejector plate 20 is provided with an annular groove 26 for fastening a sealing ring (not shown) to seal off the propelling charge gase within the projectile casing produced by the ejection charge 18. Due to its eccentric center of gravity 24, this ejector plate 20 moves laterally out of the trajectory of the central bomblet column, and thus the danger of collision or damage to the bomblets and detonation in the air is substantially reduced.

Figure 3A:
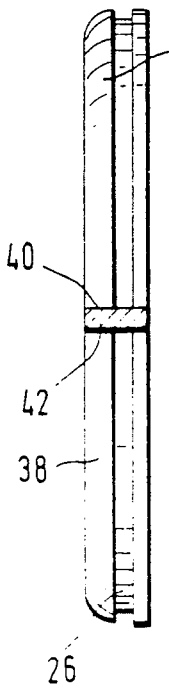
Figure 3:
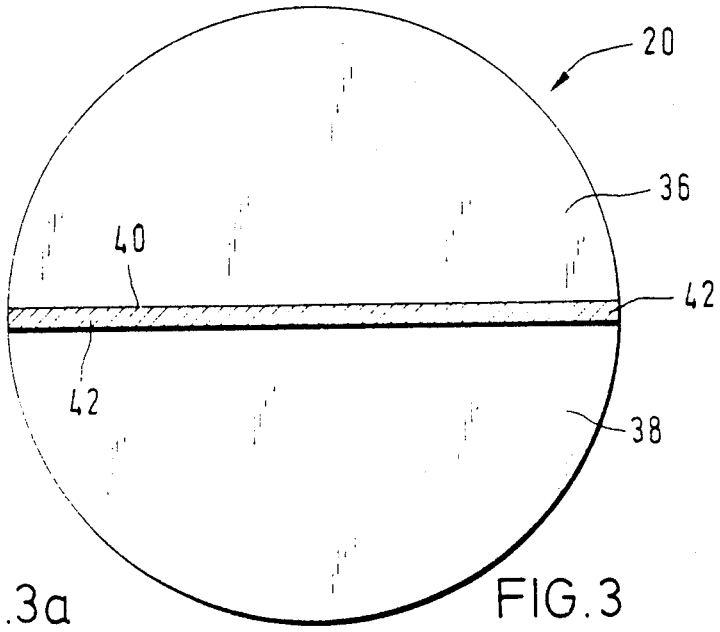

FIGS. 3 and 3*a* show a further embodiment of an ejector plate according to the invention. Here, ejector plate 20' is composed of two 180° or semicircular segments 36 and 38, which are connected with one another in their central junction or connection zone 40 by means of a vulcanization layer 42, e.g., formed of rubber, silicone or caoutchouc.

Figure 4A:
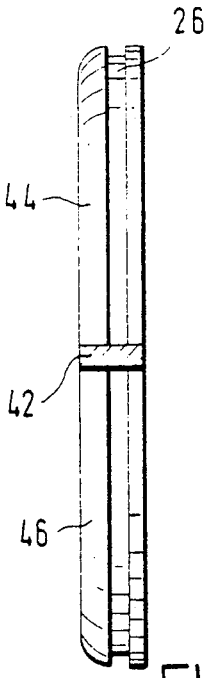
Figure 4:
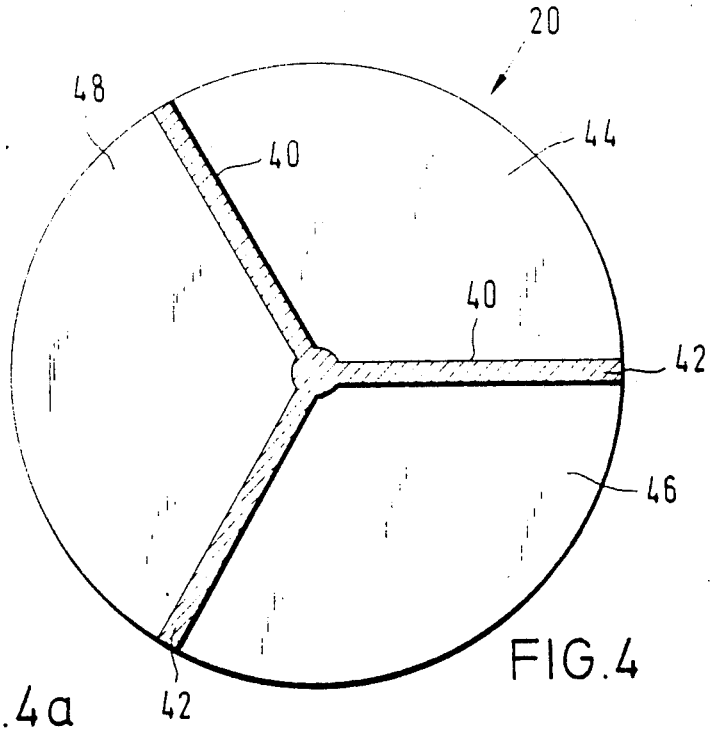

A further embodiment of an ejector plate according to the invention is shown in FIGS. 4 and 4*a*. Here, ejector plate 20'' is composed of three 120° segments which are likewise provided with a vulcanization layer 42'' in their common junction zone 40''.

The segment pieces of the ejector plates shown, for example, in FIGS. 3 and 4, could also be configured as four 90° circle segments or of members of any desired shape which form a circle.

The individual segments of the ejector plates shown, for example, in FIGS. 3 and 4, may also be "releasably" connected with one another in some other suitable manner, for example, by gluing, so long as the ejector plate, on the one hand, fully performs its ejection function and, on the other hand, is separated into its individual segments due to the action of centrifugal forces, once it leaves carrier casing 12 without endangering the payload 14. In particular, the center bomblet column of the payload should not be endangered, as would be the case with a conventional compact, solid, one-piece ejector plate.

Figure 5A:
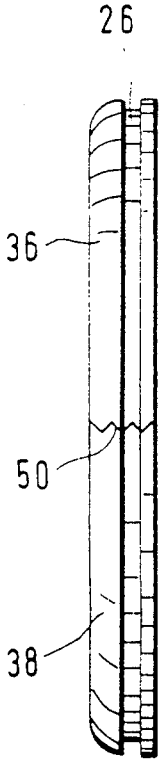
Figure 5:
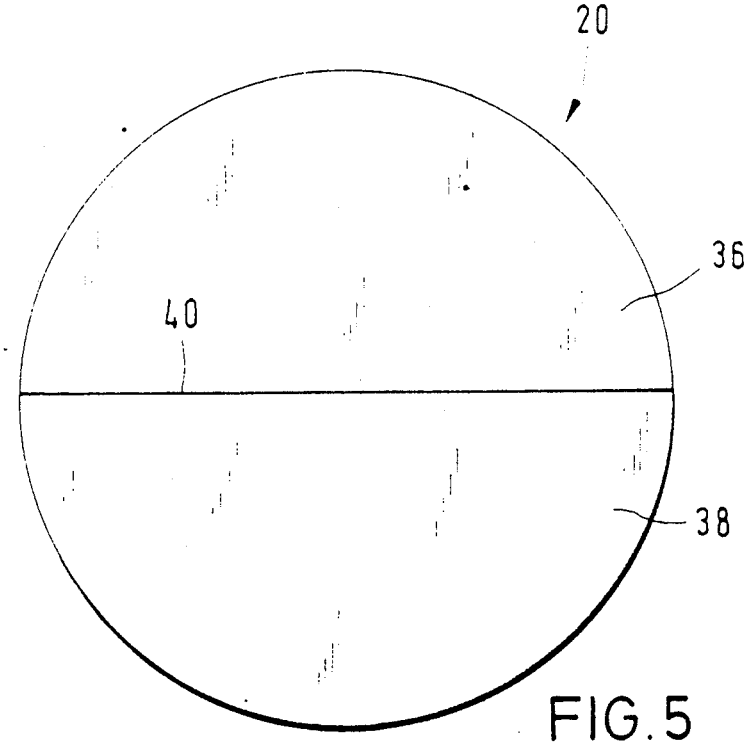

As a further embodiment, FIGS. 5 and 5*a* show a two-part ejector plate 20''' which is composed of segment halves 36' and 38' that are provided with mating teeth 50 in their common junction zone 40, i.e, the abutting edge surfaces of the plate portions 36' and 38', to produce a form-locking connection in the longitudinal direction of the projectile. Teeth 50 may be the conventional sawtooth-shaped teeth, rectangular teeth or some other suitable form lock in the form of a labyrinth seal. If teeth 50 are provided in the junction zone 40'''of the segments 36''', 38''', it is best to additionally glue the segments together in order to fix them to one another.

The invention now being fully described, it will be apparent to one of ordinary skill in the art that any changes and modifications can be made thereto without departing from the spirit or scope of the invention as set forth herein.

What is claimed:

1. In a large-caliber carrier projectile for transporting a payload to a target, said projectile including a cylindrical body containing a payload, an ejection charge disposed in a forward portion of said projectile, and a circular ejector plate disposed within said body between said ejection charge and said payload for ejecting said payload from said carrier projectile over a target area in response to detonation of said ejection charge; the improvement comprising means for providing said ejector plate with an asymmetrical distribution of mass, and thus, with an eccentric center of gravity, wherein said means for providing said eccentric center of gravity comprises an additional shaped piece attached to said ejector plate in an eccentric arrangement.

2. A carrier projectile as defined in claim 1 wherein said shaped piece is attached to "a surface of said ejector plate which faces said ejection charge."

3. A carrier projectile as defined in claim 1 wherein said ejector plate and said shaped piece are formed as a one piece unitary structure.

4. A carrier projectile as defined in claim 1 wherein said ejector plate and said shaped piece constitute separate parts and said shaped piece is fastened eccentrically to a surface of said ejector plate by one of screws, rivets, welding and gluing.

* * * * *